US008029117B2

(12) United States Patent
Dietl et al.

(10) Patent No.: US 8,029,117 B2
(45) Date of Patent: Oct. 4, 2011

(54) SELECTABLE FILL VOLUME FOR INK RESERVOIR

(75) Inventors: Steven J. Dietl, Ontario, NY (US); Brian G. Price, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 388 days.

(21) Appl. No.: 12/335,819

(22) Filed: Dec. 16, 2008

(65) Prior Publication Data

US 2010/0149287 A1 Jun. 17, 2010

(51) Int. Cl.
*B41J 2/175* (2006.01)

(52) U.S. Cl. ..... 347/86; 347/85

(58) Field of Classification Search ..... None
See application file for complete search history.

(56) References Cited

U.S. PATENT DOCUMENTS

| | | | | |
|---|---|---|---|---|
| 5,567,373 | A * | 10/1996 | Sato et al. | 264/112 |
| 5,742,312 | A | 4/1998 | Carlotta | |
| 5,745,138 | A | 4/1998 | Ostermeier | |
| 5,912,687 | A | 6/1999 | Cowger et al. | |
| 5,936,650 | A | 8/1999 | Ouchida et al. | |
| 6,302,503 | B1 | 10/2001 | Seu | |
| 6,557,990 | B2 * | 5/2003 | Altendorf | 347/92 |
| 2003/0128259 | A1 | 7/2003 | Leibman et al. | |

FOREIGN PATENT DOCUMENTS

| | | | |
|---|---|---|---|
| EP | 0 953 449 | A1 | 11/1999 |
| EP | 1 120 258 | A2 | 8/2001 |
| EP | 1 247 652 | A2 | 10/2002 |
| JP | 2007112057 | | 10/2005 |

OTHER PUBLICATIONS

U.S. Appl. No. 12/040,048, filed Feb. 29, 2008, Dual Seating Quick Connect Valve, by Biran G. Price and David R. Scott.
U.S. Appl. No. 12/139,533, filed Jun. 16, 2008, Liquid Storage Tank Including a Pressure Regulator, by Brian G. Price.
U.S. Appl. No. 12/139,544, filed Jun. 16, 2008, Ink Tank for Inkjet Printers, by Brian G. Price and David R. Scott.

* cited by examiner

*Primary Examiner* — Laura Martin
*Assistant Examiner* — Jeremy Bishop
(74) *Attorney, Agent, or Firm* — Stephen H. Shaw; Eugene I. Shkurko

(57) ABSTRACT

A method for filling an ink tank to one of several selectable ink fill volumes, by providing an ink tank including an ink reservoir having a maximum fill volume V and selecting an ink fill volume $V_i$ to store in the ink reservoir. One subsequently determines a quantity of pellets to add to the ink reservoir, wherein the total pellet volume $V_p > (V - V_i - 2)$ cubic centimeters. Upon adding the determined quantity of pellets to the ink reservoir, the ink reservoir is sealed with a lid. Whereupon, ink, in the amount $V_i$, is added to the ink reservoir.

20 Claims, 9 Drawing Sheets

SELECTABLE FILL VOLUME FOR INK RESERVOIR

FIELD OF THE INVENTION

The present invention relates generally to ink tanks for inkjet printers, and more particularly to filling of an ink tank with ink.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink chamber, an ejecting actuator and an orifice through which droplets of ink are ejected. The ejecting actuator may be one of various types, including a heater that vaporizes some of the ink in the chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the print medium is moved relative to the printhead.

Motion of the print medium relative to the printhead may consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads.

A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath.

The ink supply on a carriage printer can be mounted on the carriage or off the carriage. For the case of ink supplies being mounted on the carriage, the ink tank can be permanently mounted to the printhead, so that the printhead needs to be replaced when the ink is depleted, or the ink tank can be detachably mounted to the printhead, so that only the ink tank itself needs to be replaced when the ink tank is depleted. Carriage mounted ink tanks typically contain only enough ink for up to about several hundred prints. This is because the total mass of the carriage needs be limited, so that accelerations of the carriage at each end of the travel do not result in large forces that can shake the printer back and forth. As a result, users of carriage printers need to replace carriage-mounted ink tanks periodically, depending on their printing usage, typically several times per year.

The cost of an ink tank is related to how much ink it contains. High printing throughput users may prefer high capacity ink tanks, which have a higher selling price, but need to be replaced less frequently. Low printing throughput users may prefer low capacity ink tanks, which have a lower selling price. Ink tank manufacturers want to satisfy the requirements of a wide range of users, so it is advantageous to be able to provide a range of ink fill volumes in the ink tanks.

Providing a range of different ink fill volumes is not as simple as filling an ink reservoir in an ink tank to different levels. The ink tank should be capable of containing the ink even under conditions where the pressure within the tank changes due to environmental conditions. For example, pressure variations within an ink tank can occur due to changes in ambient temperature such as when a tank is stored at elevated temperatures in a warehouse or a particular geographic region where high temperatures are encountered. Pressure variations within an ink tank can also occur when the tank is subjected to changes in barometric pressure such as transporting the tank in an airplane or a geographic elevation high above sea level. Some types of ink tank designs are particularly susceptible to leakage due to pressure variations in the ink tank if there is excessive air in the ink tank. For example, a vented ink tank having a chamber containing free-flowing liquid ink, such as that described in U.S. Pat. No. 5,742,312 and in some of the references cited therein, is more susceptible to such pressure-variation-induced leakage than an ink tank having all of the ink retained within a porous capillary medium. If an ink reservoir in an ink tank is partially filled with free-flowing liquid ink, and the remainder of the ink reservoir volume is occupied by air, pressure variations within the ink tank due to variations in environmental pressure and temperature can become excessive and cause leakage of ink from the ink tank during shipping and storage. This results in both wastage and inconvenience for the user.

One approach that has been commonly used is to provide different geometry ink tanks that have different fill volumes. There are limitations on the amount of change in external dimensions (height, width and length) of an ink tank that can be accommodated in a carriage. For a multi-color inkjet printer, it may be possible to select one ink tank (e.g. for black ink) that is positioned at an outer region of the carriage and change its external dimensions for varying the ink capacity. However, generally the external dimensions of a full set of ink tanks cannot be made much larger or smaller than a standard size and still fit in the carriage.

Another approach is to change the volume of an ink reservoir in an ink tank by modifying the internal dimensions, e.g. by changing the position of internal walls or partitions within the ink tank body. However, each variation in ink capacity requires that a new ink tank body style be separately tooled and injection molded, adding to the cost and complexity of manufacturing.

Similarly, the internal dimensions of an ink reservoir in an ink tank can be modified by changing the size of protrusions that extend into the reservoir from the lid of the ink tank, as disclosed in commonly assigned copending U.S. patent application Ser. No. 12/139,544 filed Jun. 16, 2008. However, again each variation in ink capacity requires that a new ink lid style be separately tooled and injection molded, adding to the cost and complexity of manufacturing.

What is needed is a way of providing a range of ink fill levels in a reservoir of an ink tank, without leaving excessive air in the reservoir, and without requiring a different tank body or lid style for each ink fill level.

SUMMARY OF THE INVENTION

The need is met by providing a method for filling an ink tank to one of several selectable ink fill volumes, by providing an ink tank including an ink reservoir having a maximum fill volume V and selecting an ink fill volume $V_i$ to store in the ink reservoir. One subsequently determines a quantity of pellets to add to the ink reservoir, wherein the total pellet volume $V_p>(V-V_i-2)$ cubic centimeters. Upon adding the determined quantity of pellets to the ink reservoir, the ink reservoir is sealed with a lid. Whereupon, ink, in the amount $V_i$, is added to the ink reservoir.

Another embodiment employs an ink tank for an inkjet printing system, the ink tank including a tank body; a lid that is sealed to the tank body; and an ink reservoir formed within the tank body that is sealed by the lid, the ink reservoir having a maximum fill volume V. Ink that is contained within the ink reservoir, has a density of $D_i$ grams per cubic centimeter and a volume $V_i$. Several pellets are contained within the ink reservoir, the pellets have a density of $D_p$ grams per cubic centimeter and a total pellet volume $V_p$, wherein $D_p<D_i$ and wherein $V_p>(V-V_i-2)$ cubic centimeters.

Yet another embodiment employs an inkjet printing system that includes a printhead; a carriage for moving the printhead; and an ink tank mounted on the carriage. The ink tank itself includes: a tank body with a sealed lid; an ink reservoir formed within the sealed tank body. The ink reservoir has a maximum fill volume V; and contains an ink having a density of $D_i$ grams per cubic centimeter and a volume $V_i$. Pellets are contained within the ink reservoir, the pellets have a density of $D_p$ grams per cubic centimeter and a total pellet volume $V_p$, wherein $D_p<D_i$ and wherein $V_p>(V-V_i-2)$ cubic centimeters.

DETAILED DESCRIPTION OF THE INVENTION

Figure 1:
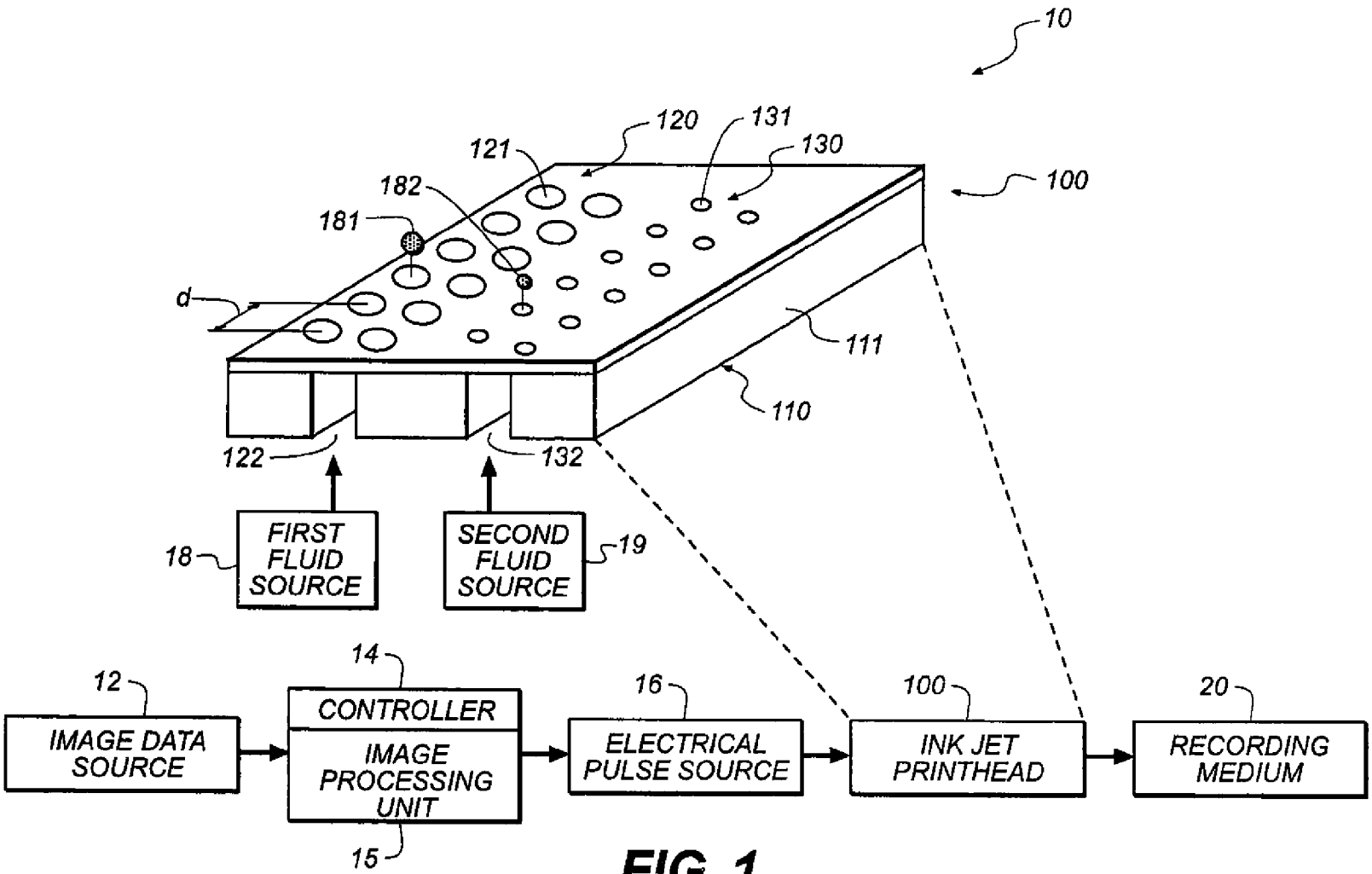
FIG. 1 schematically shows an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles in the first array 121 in the first nozzle array 120 have a larger opening area than nozzles in the second array 131 in the second nozzle array 130. In this example, each of the two nozzle arrays has two staggered rows of nozzles, each row having a nozzle density of 600 per inch. The effective nozzle density then in each array is 1200 per inch. If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of fluid delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to nozzle the first nozzle array 120 and the second nozzle array 130 via ink delivery pathways 122 and 132 respectively. Also, in some embodiments, fewer than two or more than two nozzle arrays may be included on printhead die 110. In some embodiments, all nozzles on inkjet printhead die 110 may be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
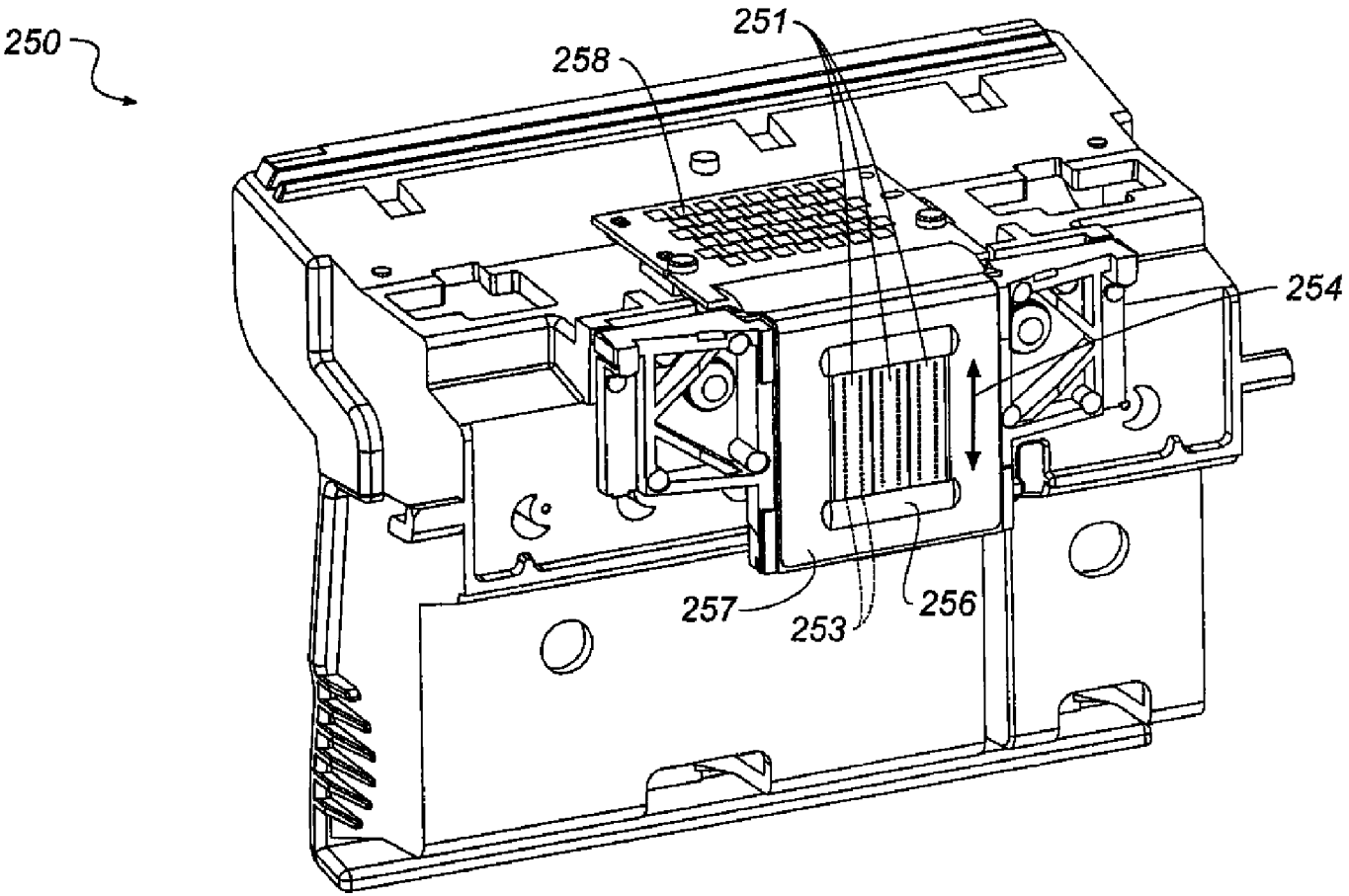
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid. Each of the six nozzle arrays 253 is disposed along nozzle array direction 254, and the length of each nozzle array along direction 254.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
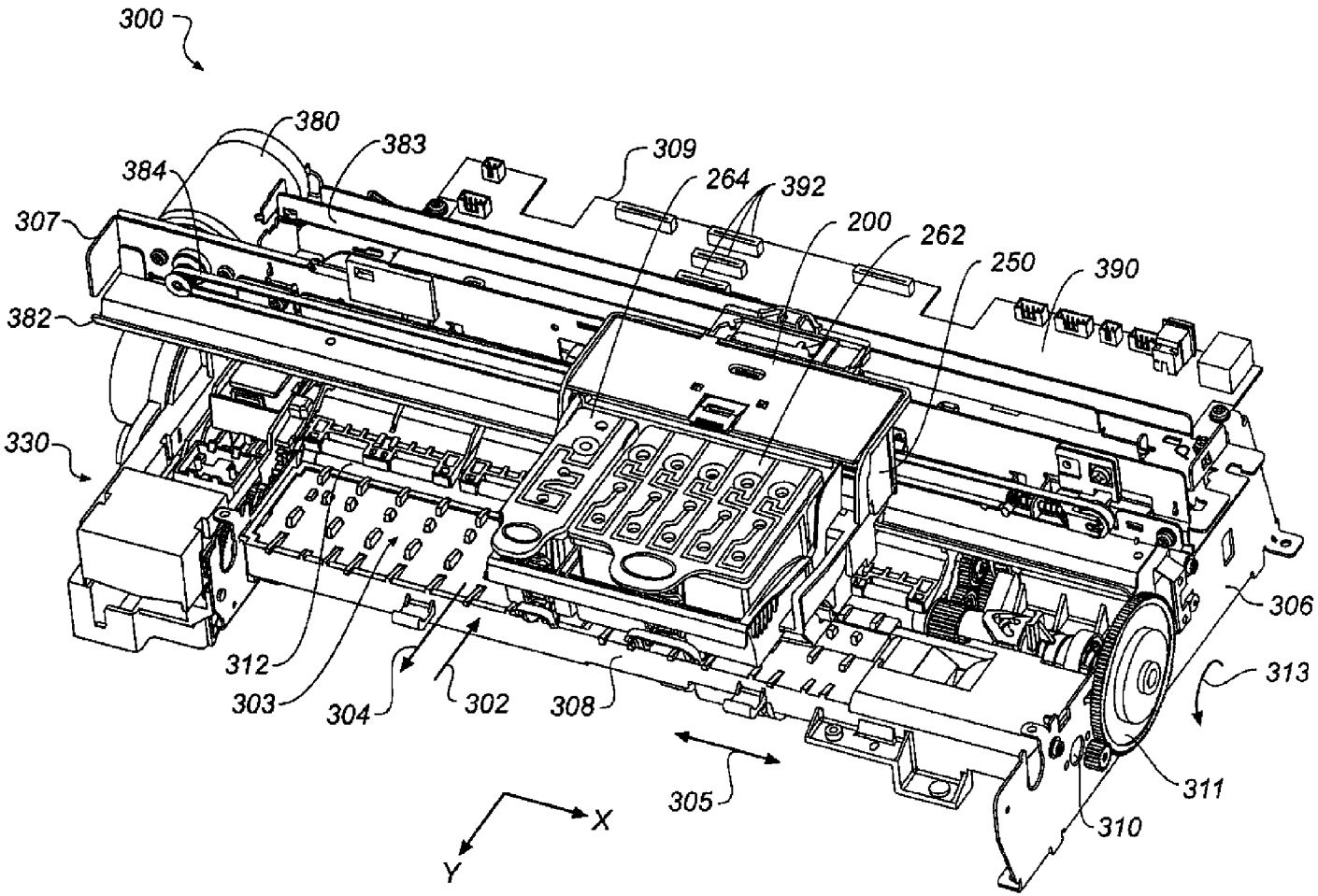
FIG. 3 is a perspective view of a portion of a carriage printer.

FIG. 3 shows a portion of a desktop carriage printer. Some of the parts of the printer have been hidden in the view shown in FIG. 3 so that other parts may be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-reservoir ink supply 262 and single-reservoir ink supply 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-reservoir ink supply 262, in this example, contains five ink sources: cyan, magenta, yellow, photo black, and colorless protective fluid; while single-reservoir ink supply 264 contains the ink source for text black. Paper or other recording medium (sometimes generically referred to as paper or media herein) is loaded along paper load entry direction 302 toward the front of printer chassis 308.

A variety of rollers are used to advance the medium through the printer, including feed roller 312. The motor that powers the paper advance rollers is not shown in FIG. 3, but the hole 310 at the right side 306 of the printer chassis 300 is where the motor gear (not shown) protrudes through in order to engage feed roller gear 311 for feed roller 312, as well as the gear for the discharge roller (not shown). For normal paper pick-up and feeding, it is desired that all rollers rotate in forward direction 313. Toward the let side 307 in the example of FIG. 3 is the maintenance station 330.

Toward the rear 309 of the printer in this example is located the electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 4:
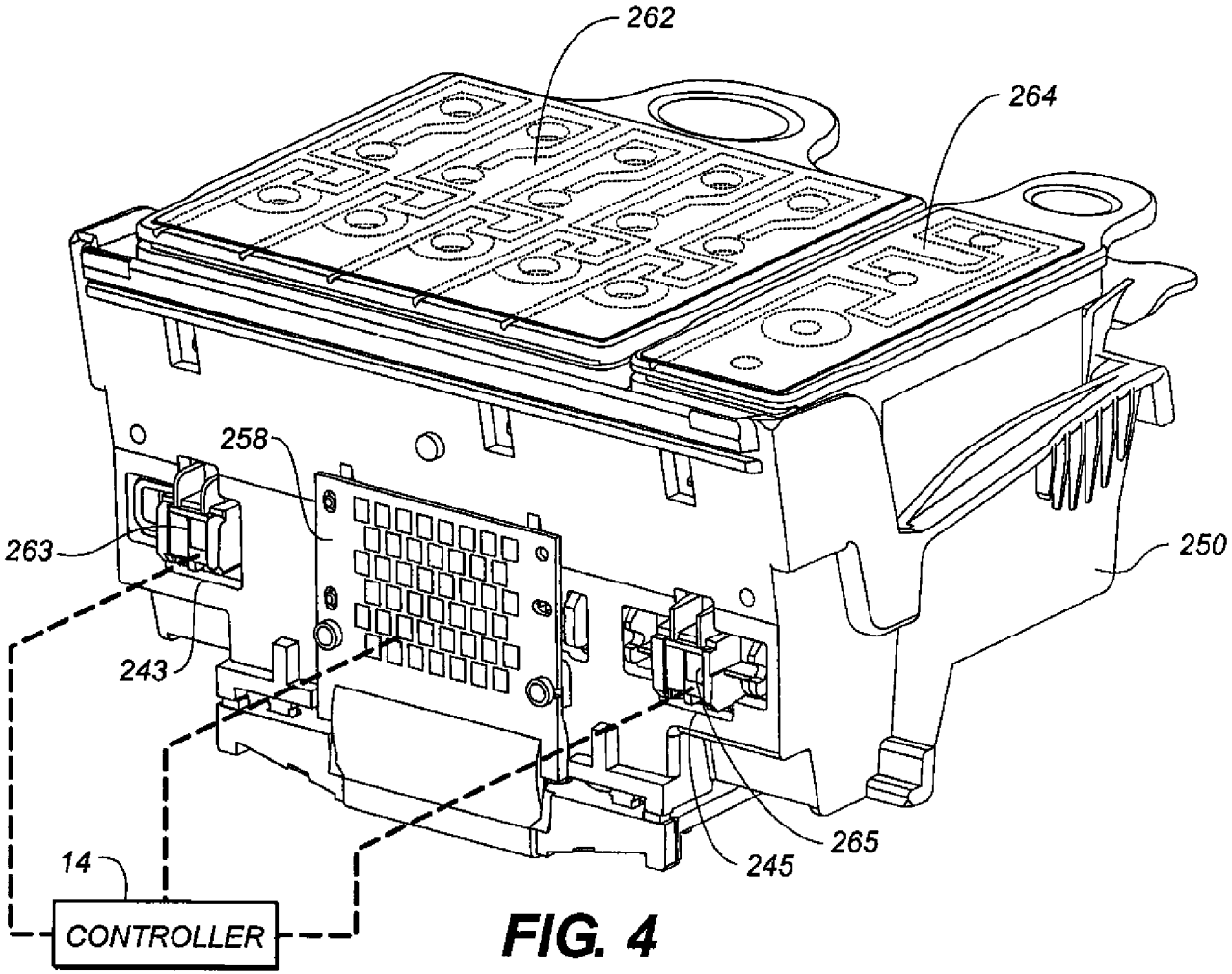
FIG. 4 is a perspective view of a printhead chassis with ink tanks mounted.

FIG. 4 shows a perspective view of printhead chassis 250 that is rotated relative to the view in FIG. 2. Replaceable ink tanks (multi-reservoir ink tank 262 and single reservoir ink tank 264) are shown mounted in printhead chassis 250. Multi-reservoir ink tank 262 includes a memory device 263, and single reservoir ink tank 264 includes a memory device 265. The memory devices 263 and 265 are typically used to provide information to controller 14 of the printer, and also to store data regarding the amount of ink that has been used from the each reservoir of the ink tank. Memory devices 263 and 265 protrude through holes 243 and 245 respectively in printhead chassis 250. In this way, contact pads on memory devices 263 and 265 and connector board 258 may easily be contacted by a connector in carriage 200, and from there through cables to cable connectors 392 on electronics board 390.

Figure 5:
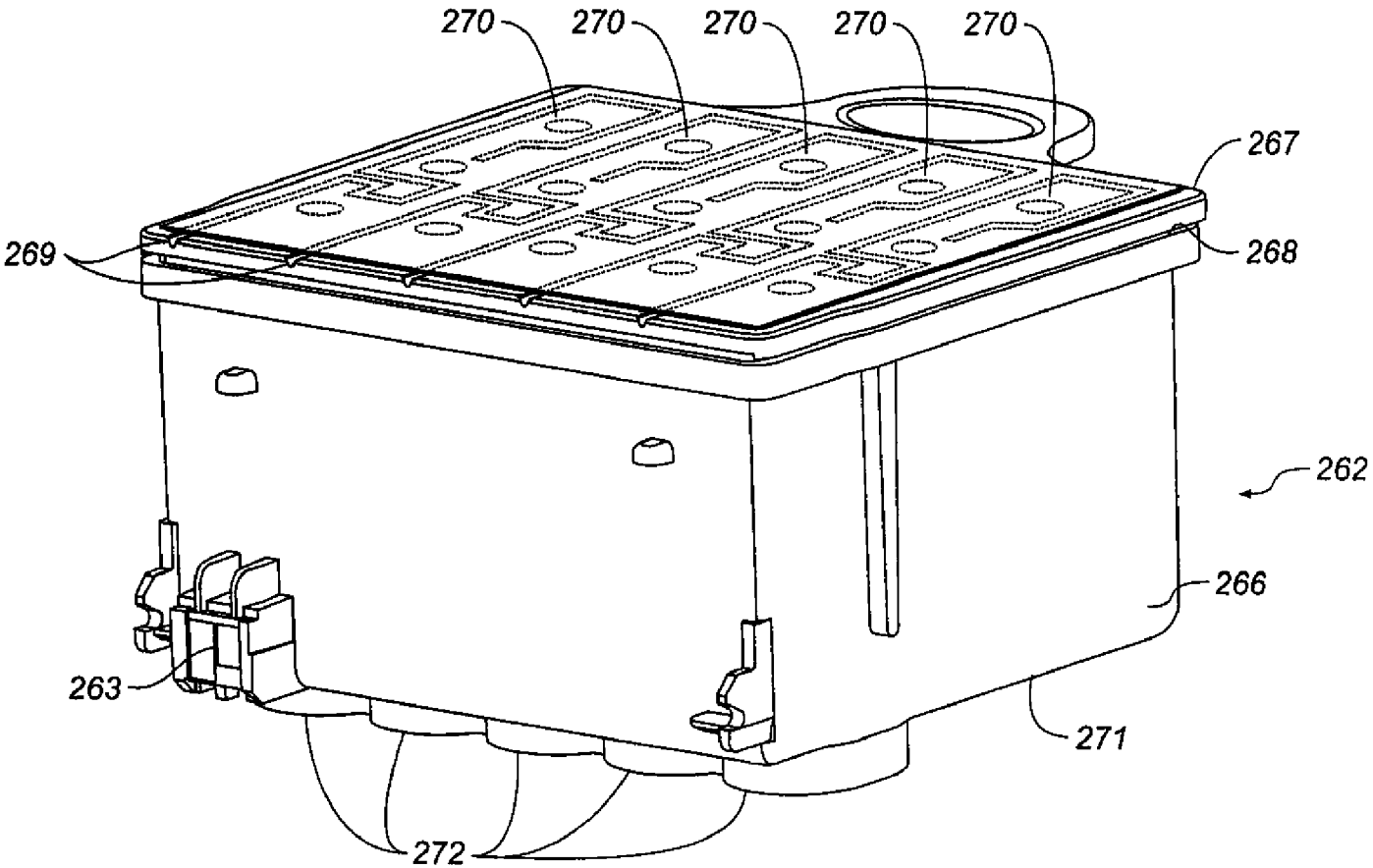
FIG. 5 is a perspective view of multi-reservoir ink tank.

FIG. 5 shows a perspective view of multi-reservoir ink tank 262 removed from printhead chassis 250. Multi-reservoir ink tank 262 includes a tank body 266 and a lid 267 that is sealed (e.g. by welding) to tank body 266 at lid sealing interface 268. Lid 267 individually seals all of the reservoirs 270 in the ink tank. In this example, multi-reservoir ink tank 262 has five reservoirs 270 below lid 267, and each reservoir has a corresponding ink tank port 272 that is used to transfer ink to the printhead die 251. As shown in FIG. 3, the ink tanks 262 and 264 are mounted on the carriage 200 printing system chassis 300, such that the lid 267 is at an upper surface, and correspondingly ink tank port 272 is at a lower surface. Ink tank port 272 is typically located on a tank bottom 271 that is opposite lid 267, although in some designs (not shown), the ink tank port 272 is located on a side of the ink tank reservoir 270. In any case, in order to help make liquid ink in the reservoir 270 accessible for use, ink tank port 272 is generally located closer to the tank bottom 271 than it is to the lid 267, whether or not the ink tank port 272 is actually located on the tank bottom 271. Corresponding to each reservoir position, there is a circuitous air path in lid 267 (shown as dotted lines) that exits the side of lid 267 at vents 269 (only two of which are labeled in FIG. 5 for improved clarity). Vent 269 helps to relieve pressure differences in reservoir 270 as ink is depleted during usage. However, if there is too much pressure build-up in reservoir 270 (e.g. due to barometric pressure or temperature excursions during shipping or storage), ink can undesirably be forced out of vent 269.

Figure 6:
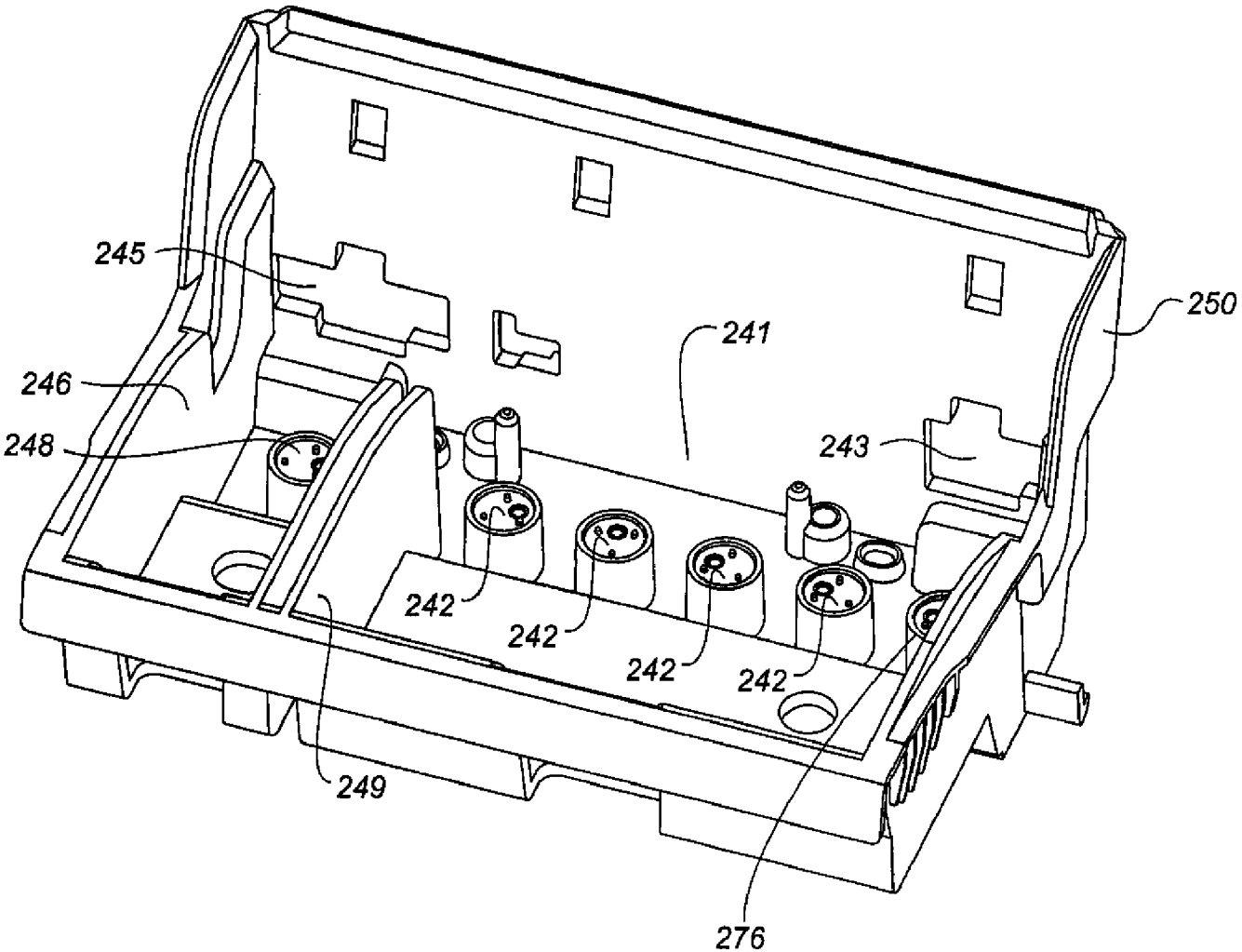
FIG. 6 is a perspective view of a printhead chassis without ink tanks mounted.

FIG. 6 shows a perspective view of printhead chassis without either replaceable ink tank 262 or 264 mounted in it. Multi-reservoir ink tank 262 is mountable in a region 241 and single reservoir ink tank 264 is mountable in region 246 of printhead chassis 250. Region 241 is separated from region 246 by partitioning wall 249, which can also help guide the ink tanks during installation. Five ports 242 are shown in region 241 that connect with ink tank ports 272 of multi-reservoir ink tank 262 when it is installed, and one port 248 is shown in region 246 for the ink tank port on the single reservoir ink tank 264. When an ink tank is installed in the printhead chassis 250, it is in fluid communication with the printhead because of the connection of ink tank port 272 with ports 242 or 248.

Ink tanks typically include some sort of pressure regulation means, so that the ink is provided to the printhead with sufficient negative pressure that ink does not weep from the nozzles, but also without excessive negative pressure that can cause ink starvation during high-density, fast-throughput printing. In many types of ink tanks, in addition to the pressure regulation means, there is a reservoir containing free-flowing liquid ink. Commonly assigned copending U.S. patent application Ser. No. 12/139,533 filed Jun. 16, 2008, discloses a pressure regulator including a vented enclosure that extends downward from the lid into a free liquid ink reservoir. Within the enclosure is contained capillary media to provide pressure regulation. One or more holes in the enclosure are provided to allow air to pass into the free liquid ink reservoir as ink is used during operation of the inkjet printer.

Figure 7A:
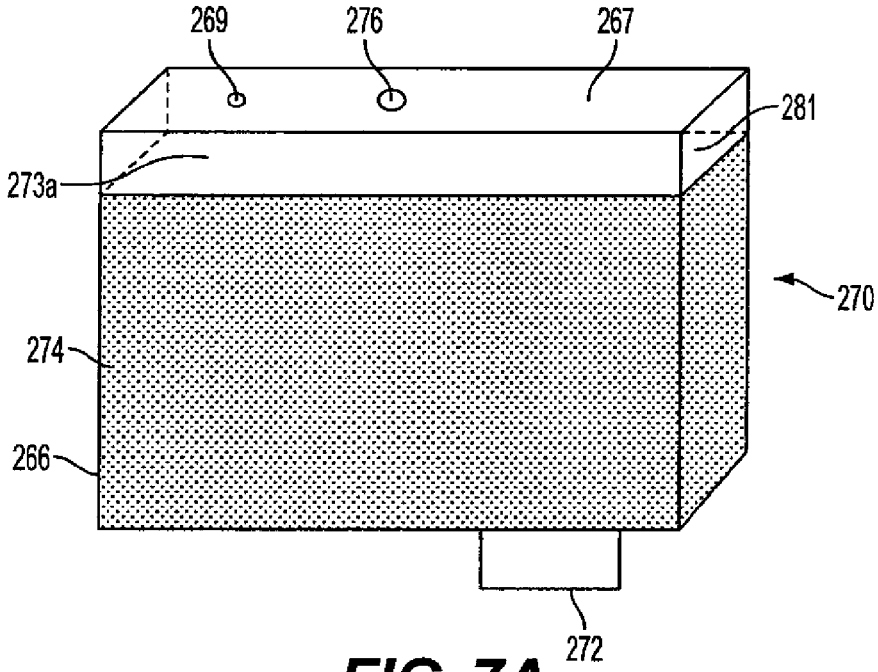
FIG. 7A is a schematic view of an ink reservoir that is filled to a nearly full ink fill level with liquid ink.
Figure 7B:
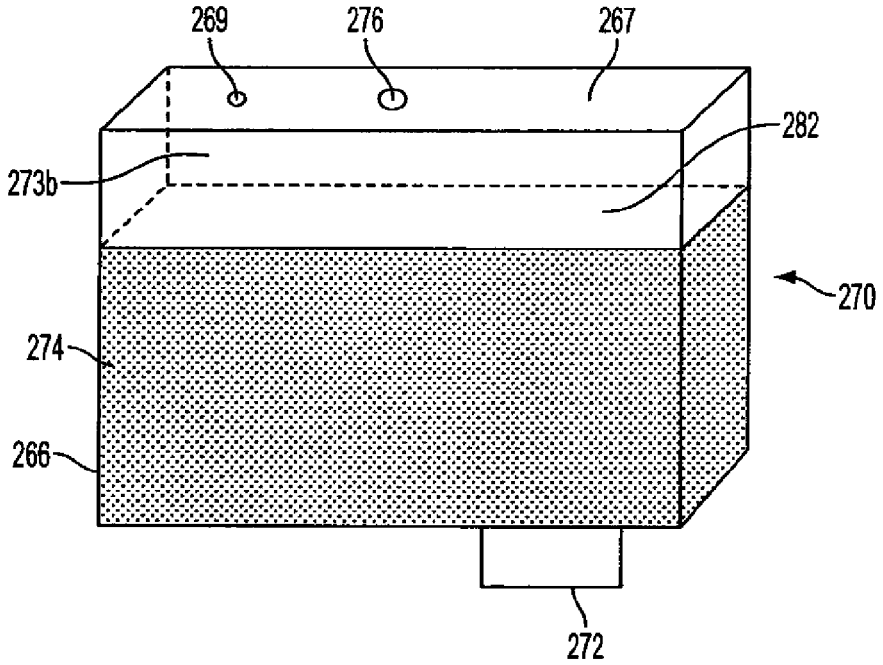
FIG. 7B is a schematic view of an ink reservoir that is filled to a lower fill level with liquid ink.

FIGS. 7A and 7B schematically show ink reservoir 270 having free-flowing liquid ink 274 filled to nearly full ink fill level 281 and lower ink fill level 282 respectively. For simplicity, pressure regulation means for ink reservoir 270 is not shown. However, "free-flowing liquid ink 274" refers to ink that is not held within a porous capillary medium, for example, which would restrict its movement in the reservoir 270. Ink is filled into reservoir 270 through ink fill hole 276 in lid 267. Optionally, the ink fill hole 276 can subsequently be sealed over with an adhesive-coated label (not shown). The shaded region 274 represents the free liquid ink, and the regions 273*a* and 273*b* inside reservoir 270 above the free liquid ink 274 is full of air. It has been found that for some designs of ink tanks, if air spaces 273*a* and 273*b* are larger than about one to two cubic centimeters, pressure changes inside the tank due to environmental changes during shipping and storage can cause ink to leak from vent 269 (shown in FIGS. 7A and 7B as a hole in lid 267). For example, suppose the volume of ink reservoir 270 is 16 ml, and air space 273*a* above nearly full ink fill level 281 in FIG. 7A is 1 ml (i.e. 1 cubic centimeter), so that the net amount of ink in the reservoir 270 is 15 ml. Such a fill level can be acceptable without causing ink leak problems. However, suppose the volume of ink reservoir 270 is 16 ml, and air space 273*b* above lower ink fill level 282 in FIG. 7B is 3 ml (i.e. 3 cubic centimeters), so that the net amount of ink in the reservoir 270 is 13 ml. This lower ink fill level 282 would be likely to lead to ink leaks in some environmental conditions of shipping and storage, and is therefore an unacceptable fill level. Thus for a single geometry of lid 267 and tank body 266, providing a reliably non-leaking ink tank having a range of ink fill volumes in a vented free-ink reservoir has not been feasible in the past.

Embodiments of the present invention allow providing a reliably non-leaking ink tank having a range of ink fill volumes in a vented free-ink reservoir by adding sufficient filler material (also called pellets herein) to occupy a volume of space that would otherwise be occupied by air after filling to a desired ink fill level. Because the pellets displace the air during the ink filling process, only an acceptable amount of air (e.g. 2 cubic centimeters or less) remains, and pressure changes inside the tank due to environmental changes during shipping and storage do not cause ink to leak. In particular, if the reservoir volume is V and the desired ink fill volume is $V_i$, then the volume of pellets $V_p$ that is added to the reservoir is such that $V_p$ is greater than $(V-V_i-2)$ cubic centimeters, and $V_p$ is less than $(V-V_i)$, so that between 0 and 2 cubic centimeters of air remains in the reservoir.

Figure 8A:
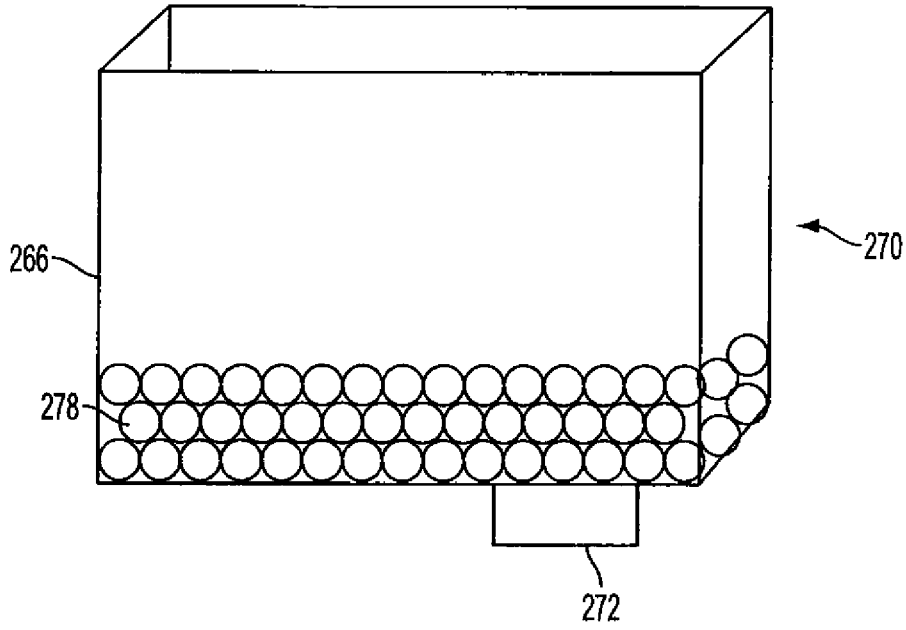
FIG. 8A is a schematic view of an ink reservoir according to an embodiment of the present invention, with a determined quantity of pellets added to displace a volume of air.
Figure 8B:
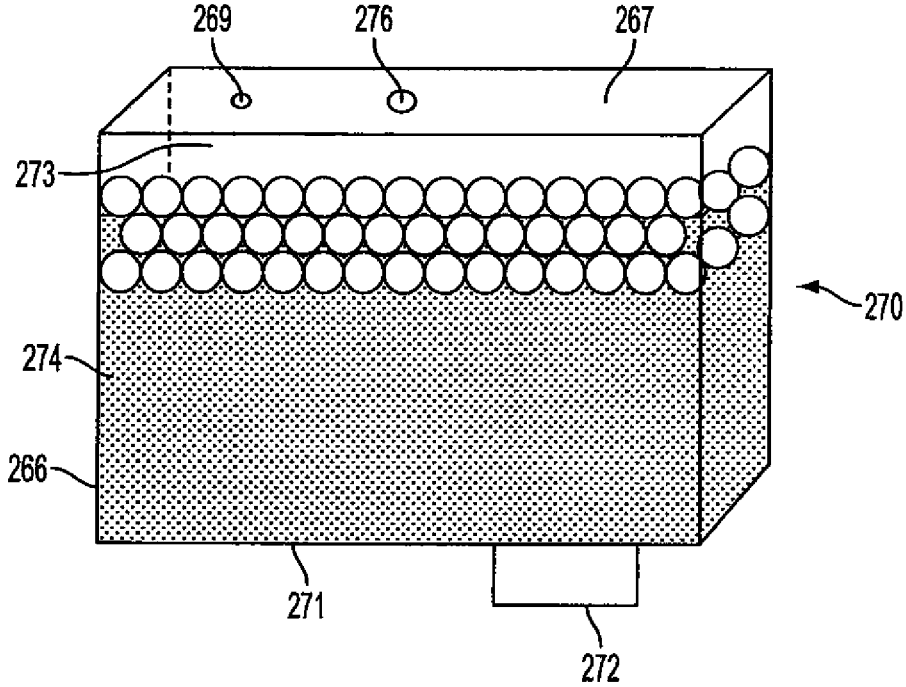
FIG. 8B is a schematic view of the ink reservoir shown in FIG. 8A with a selected volume of ink filled into the reservoir.

FIGS. 8A and 8B show an embodiment of the present invention, using views similar to those in FIGS. 7A and 7B. In FIG. 8A reservoir 270 does not yet have lid 267 sealed to the tank body 266. An ink fill volume is selected for reservoir 270 that would have provided an unacceptably large air space, as in FIG. 7B. However, pellets 278 are added to reservoir 270 before attaching lid 267. In the example shown in FIG. 8A, all of the pellets are round and have substantially the same volume $v_p$. Pellets 278 can be spherical, oval, cylindrical, or a variety of other shapes having a round surface, or not having a round surface. Suppose, for example, that pellets 278 are spheres having a diameter of 5.8 mm and a volume $v_p$ of 0.10 cubic centimeter. If ink reservoir 270 has an internal volume of 16 ml (a maximum fill volume V=16 ml), but the selected ink fill volume $V_i$ is 10 ml, then the remaining volume is 6 ml. A substantial portion of the air in the reservoir 270 is displaced, however, by pellets 278 so that an acceptable amount of air remains after adding the ink. For example, in FIG. 8A, forty-eight pellets 273 are shown. If each pellet has a volume of 0.10 cubic centimeter, then the total volume $V_p$ occupied by the forty-eight pellets 278 is 4.8 cubic centimeters, leaving only an acceptable 1.2 cubic centimeters of air when the selected amount of 10 ml of ink is added to the reservoir 270. In this example, anywhere between forty and sixty pellets 273 could have been added to reservoir 270 and consequently left between 2 cubic centimeters and 0 cubic centimeters of air in the 16 ml reservoir 270 after 10 ml of ink is added. To leave 2 cubic centimeters of air in reservoir 270, the number $N_p$ of pellets 278 to be added is $N_p=(V-V_i-2)/v_p=40$. To leave 0 cubic centimeters of air in reservoir 270, the number $N_p$ of pellets 278 to be added is $N_p=(V-V_i)/v_p=60$.

In FIG. 8B, the lid 267 has been sealed to the tank body 266, and the selected fill volume $V_i$ of free liquid ink 274 has then been injected into reservoir 270 through ink fill hole 276. Although there is still an air space 273, its volume is less than if the pellets 273 had not been added. FIG. 8B shows an example where the pellets have a mass per unit volume $D_p$ that is less than the mass per unit volume $D_i$ of the ink, so that buoyant forces cause the pellets 273 to float in the free ink 274. (For water-based ink, $D_i$ is typically around 1 gram per cubic centimeter, so a pellet mass per unit volume $D_p$ less than 1 gram per cubic centimeter would be appropriate.) This can be advantageous in that the floating pellets 273 are kept away from ink tank port 272, so that ink flows freely through the ink tank port 272. Other measures for keeping the pellets 278 from obstructing ink tank port 272 include making them rounded, and also making them sufficiently large that they do not lodge in small orifices. Some types of ink tank ports 272 include a movable valve with orifices for delivering ink to a port such as 242 or 248 in the printhead chassis (see FIG. 6). For example, commonly assigned copending U.S. patent application Ser. No. 12/040,048 discloses such a valve.

Pellets 278 having a mass per unit volume $D_p$ that is less than the mass per unit volume of the ink $D_i$ will tend to float at the ink/air interface near lid 267 when the ink tank is oriented in a configuration with the lid 267 pointing up, as it is in the printer chassis view of FIG. 3. How many of the pellets 278 are fully submerged in the ink and how many are partially exposed to air in air space region 273, depends upon the pellet mass per unit volume $D_p$, the ink mass per unit volume $D_i$, and the difference between the maximum fill volume V and the ink volume $V_i$. Whether the pellets 278 displace air directly in air space region 273, or displace air indirectly by displacing ink that displaces air in air space region 273, the presence of pellets 278 results in less air being trapped in the reservoir 270 that can lead to leaking during shipping and storage.

In a filled ink tank, buoyant forces will constrain pellets having $D_p<D_i$ to be located closer to the lid 267 than to the tank bottom 271 (and the ink tank port 272), as shown in FIG. 8B, where the numerical density of pellets 278 is high near lid 267 and very low (or zero) near tank bottom 271. For filled ink tanks, according to embodiments of the present invention, typically at least two-thirds of the pellets 278 are closer to the lid 267 than they are to the tank bottom 271.

The desirable size for pellets 278 in embodiments of this invention is influenced by considerations including a) having a large enough dimension so as not to lodge in orifices as described above, b) having sufficient volume $v_p$ so that large numbers of pellets are not required to be added during the manufacturing process, and c) having a small enough volume $v_p$ that desired ink fill levels can be provided with an appropriate degree of resolution. In the example described above, a volume of each pellet of 0.1 cubic centimeter was described, having a diameter of about 6 mm. This pellet size meets requirements a), b) and c), providing a possible resolution between ink fill levels of 0.1 ml if desired, and also not requiring excessively large numbers of pellets 278 to be added to the reservoir 270. However, in other embodiments, the volume of a pellet 278 can be as small as 0.001 cubic centimeter or as large as 1 cubic centimeter. In various embodiments, depending on reservoir maximum fill volume, desired ink fill volume, and pellet size, as few as three pellets 278 might be added and as many as three hundred pellets 278 might be added to a reservoir 270, for example, although the invention is not restricted to the range of 3 to 300 pellets.

In some embodiments it is desirable to provide different fill levels in different reservoirs 270 of a multi-reservoir ink tank 262, even though the maximum fill volumes V of each reservoir 270 may be the same. For example, the printer manufacturer may want to appropriately balance the amount of different inks supplied in each reservoir 270, so that for typical printing usage, all of the inks (cyan, magenta, yellow, black, protective fluid, etc.) will be depleted at about the same time, in order to minimize waste and cost. In order to accomplish the desired different fill levels, different total pellet volumes (e.g. different numbers of pellets 278) can be added to different reservoirs 270 in the multi-reservoir ink tank 262.

Pellets 278 can be solid or hollow, but for embodiments incorporating buoyant pellets, the mass per unit volume $D_p$ should be less than the ink density $D_i$. The material of the pellet 278 should be inert with respect to the ink. Pellets 278 can be made using a variety of plastic resins, such as polypropylene, for example. Amorphous polypropylene has a mass per unit volume of 0.85 gram per cubic centimeter, while crystalline polypropylene has a mass per unit volume of 0.95 gram per cubic centimeter. Both types have a mass per unit volume that is less than a typical ink $D_i$ which is around 1.1 gram per cubic centimeter for a typical water-based ink.

Some types of recycled plastic are also suitable for use in making pellets 278, and provide the further advantage of environmental sustainability. In some embodiments, pellets 278 can be recovered from depleted ink tanks and reused in new ink tanks. Alternatively, ink tanks can be refilled, and the pellets 278 be reused in that way. For ink tanks to be refilled, it is useful to know how much ink can be injected into each reservoir 270. In order to provide that information, the memory device (e.g. 263 or 265 described above with reference to FIG. 4) can be programmed to store not only the maximum fill volume of each reservoir 270, but also the total pellet volume $V_p$ in each reservoir 270, and to track the amount of ink still remaining after printing and maintenance operations.

For ink tank designs in which the lid 267 is a flat lid that seals reservoir 270, the maximum fill volume V is essentially the internal volume of the portion of the reservoir 270 within tank body 266. For ink tank designs in which the lid 267 has a projection (not shown) downward into reservoir 270, the volume of the projection needs to be taken into consideration in calculating the maximum fill volume V. Similarly, for ink tank designs in which the lid 267 has a recess (not shown) over the reservoir 270, the volume of the recess needs to be taken into consideration in calculating the maximum fill volume V.

In the embodiment described above relative to FIGS. 8A and 8B, pellets 278 having a single uniform volume $v_p$ were used. In some embodiments, pellets 278 can have more than one predetermined volume. One benefit of having more than one predetermined volume is that fewer pellets 278 can be added to the reservoir 270 to displace the required amount of air, and yet provide a high degree of resolution. In the example described above where a single pellet volume $v_p$ of 0.1 cubic centimeter was used to provide a total pellet volume $V_p$ of 4.8 cubic centimeters, forty-eight pellets were used. In another example, a first predetermined pellet volume $v_{p1}$ can be 0.1 cubic centimeter and a second predetermined pellet volume $v_{p2}$ can be 0.5 cubic centimeter. To provide a total pellet volume $V_p$ of 4.8 cubic centimeters, one could add three pellets having the first predetermined pellet volume $v_{p1}$ and nine pellets having the second predetermined pellet volume $v_{p2}$.

Figure 9A:
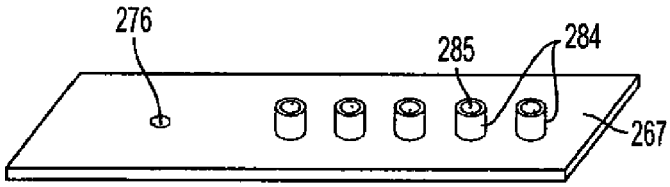
FIGS. 9A to 9E schematically show an embodiment of the present invention in which a selected quantity of pellets are anchored to a lid for the reservoir.
Figure 9B:
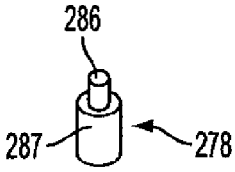
Figure 9C:
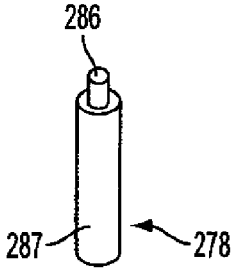
Figure 9D:
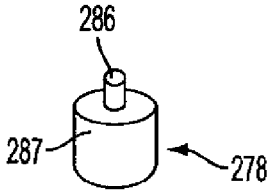
Figure 9E:
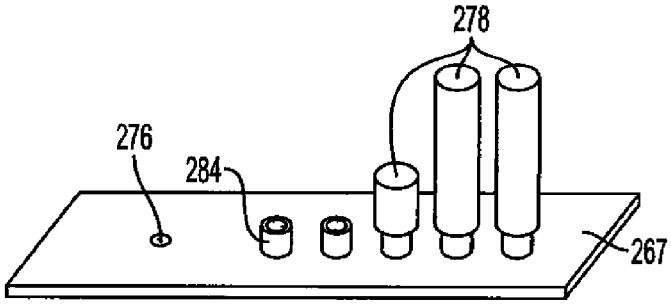

In embodiments described above, pellets 278 have been movable relative to reservoir 270 and its lid 267. For the case of pellets 278 where $D_p$ is less than $D_i$, the pellets 278 float near the surface of the free liquid ink 274. FIGS. 9A to 9E show an embodiment in which the pellets 278 are anchored to the underside of lid 267. Anchored pellets will stay near lid 267 and away from ink tank port 272 regardless of the level of free liquid ink 274 as ink is used for printing and maintenance. FIG. 9A shows a lid 267 having a group of collars 284 extending from the underside of the lid 267. Each collar has an opening 285. FIGS. 9B to 9D show several different geometries of pellets 278, where the pellets 278 each contain a pin 286, which is sized to fit into opening 285 of collar 284, and a body 287. Different pellets can have the same body volume or different body volumes, where the body volume is determined by its length and cross-sectional area as seen in FIGS. 9B to 9D. As in embodiments described above, an ink fill volume $V_i$ is selected, and a total pellet volume $V_p$ is determined such that $V_p$ is greater than $(V-V_i-2)$ cubic centimeters. Then the required number of pellets 278 is determined depending on pellet volume $v_p$. Then the pellets 278 are anchored to lid 267, e.g. by press fitting pins 286 into the openings 285 in collars 284. Then the lid 267 is sealed to the tank body 266, thereby sealing reservoir 270, such that the anchored pellets 278 extend into the reservoir 270. An amount of ink $V_i$ is injected into the reservoir 270 through ink fill hole 276 in lid 267. Although in this example, the pellets 278 are anchored to the underside of lid 267 (which is one internal surface of reservoir 270) in other embodiments, the pellets 278 can be anchored to an internal surface of reservoir 270 that is part of ink tank body 266.

The invention has been described in detail with particular reference to certain preferred embodiments thereof, but it will be understood that variations and modifications can be effected within the spirit and scope of the invention. In particular, although the embodiments described above were for ink tanks that are detachably mounted to a printhead at an ink tank port, the invention can also be used for selectable ink fill volumes of ink cartridges in which the printhead and ink tank are integrated together.

PARTS LIST

10 Inkjet printer system
12 Image data source
14 Controller
15 Image processing unit
16 Electrical pulse source
18 First fluid source
19 Second fluid source
20 Recording medium
100 Ink jet printhead
110 Ink jet printhead die
111 Substrate
120 First nozzle array
121 Nozzle(s) in first nozzle array
122 Ink delivery pathway (for first nozzle array)
130 Second nozzle array
131 Nozzle(s) in second nozzle array
132 Ink delivery pathway (for second nozzle array)
181 Droplet(s) (ejected from first nozzle array)
182 Droplet(s) (ejected from second nozzle array)
200 Carriage
241 Region for mounting multichamber ink tank
242 Port to connect to multichamber ink tank
243 Hole in printhead chassis
245 Hole in printhead chassis

246 Region for mounting single chamber ink tank
248 Port to connect to single chamber ink tank
249 Partitioning wall
250 Printhead chassis
251 Printhead die
253 Nozzle array
254 Nozzle array direction
256 Encapsulant
257 Flex circuit
258 Connector board
262 Multi-reservoir ink tank
263 Memory device
264 Single reservoir ink tank
265 Memory device
266 Tank body
267 Lid
268 Lid sealing interface
269 Vent
270 Ink reservoir
271 Tank bottom
272 Ink tank port
273 Air space
274 Free liquid ink
276 Ink fill hole
278 Pellets
281 Nearly full ink fill level
282 Lower ink fill level
284 Collar
285 Opening
286 Pin
287 Body
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
330 Maintenance station
380 Carriage motor
382 Carriage guide rail
383 Encoder fence
384 Belt
390 Printer electronics board
392 Cable connectors

The invention claimed is:

1. A method for filling an ink tank to one of a plurality of selectable ink fill volumes, the method comprising the steps of:

providing an ink tank including an ink reservoir having a maximum fill volume V;

selecting an ink fill volume $V_i$ to store in the ink reservoir;

determining a quantity of pellets to add to the ink reservoir, wherein the total pellet volume $V_p>(V-V_i-2)$ cubic centimeters;

adding the determined quantity of pellets to the ink reservoir;

sealing the ink reservoir with a lid; and adding an ink in the amount $V_i$ to the ink reservoir.

2. The method claimed in claim 1, the pellets each having a volume that is substantially equal to $v_p$, wherein the step of determining the quantity of pellets to add to the ink reservoir further includes determining a number $N_p$ of pellets to add to the ink reservoir, where $N_p>(V-V_i-2 \text{ cubic centimeters})/v_p$.

3. The method claimed in claim 2, wherein $0.001<v_p<1$ cubic centimeter.

4. The method claimed in claim 1, wherein the step of adding the determined quantity of pellets to the ink reservoir further comprises anchoring the pellets to an internal surface of the ink reservoir.

5. The method claimed in claim 1, wherein the pellets have a density that is less than 1 gram per cubic centimeter.

6. The method claimed in claim 1, wherein the pellets have a mass per unit volume that is less than the mass per unit volume of the ink.

7. The method claimed in claim 1, wherein the step of sealing the ink reservoir with a lid is performed before the step of adding ink to the ink reservoir.

8. An ink tank for an inkjet printing system, the ink tank comprising:

a tank body;

a lid that is sealed to the tank body;

an ink reservoir formed within the tank body that is sealed by the lid, the ink reservoir having a maximum fill volume V;

an ink that is contained within the ink reservoir, the ink having a density of $D_i$ grams per cubic centimeter and having a volume $V_i$; and a plurality of pellets contained within the ink reservoir, the pellets having a density of $D_p$ grams per cubic centimeter and having a total pellet volume $V_p$, wherein $D_p<D_i$ and wherein $V_p>(V-V_i-2)$ cubic centimeters.

9. The ink tank claimed in claim 8, the tank body further comprising a tank bottom that is disposed opposite the lid, wherein at least two-thirds of the pellets are constrained by buoyancy to be located closer to the lid than they are to the tank bottom.

10. The ink tank claimed in claim 9, further comprising an ink tank port that is located closer to the tank bottom than it is to the lid.

11. The ink tank claimed in claim 10, wherein the ink tank port includes a valve.

12. The ink tank claimed in claim 8, wherein the pellets comprise a plastic resin.

13. The ink tank claimed in claim 12, wherein the pellets comprise recycled plastic.

14. The ink tank claimed in claim 8, wherein the plurality of pellets includes between 3 pellets and 300 pellets.

15. The ink tank claimed in claim 8, wherein the pellets include a rounded surface.

16. The ink tank claimed in claim 8, the ink reservoir being a first ink reservoir containing a first type of ink, the ink tank further comprising a second ink reservoir containing a second type of ink, wherein the second ink reservoir includes a different number of pellets than the first ink reservoir.

17. The ink tank claimed in claim 8, further comprising a memory device, wherein the information stored in the memory device includes the total volume $V_p$ of the plurality of pellets.

18. An inkjet printing system comprising:

a printhead;

a carriage for moving the printhead;

an ink tank mounted on the carriage, the ink tank comprising:

a tank body;

a lid that is sealed to the ink tank body;

an ink reservoir formed within the tank body that is sealed by the lid, the ink reservoir having a maximum fill volume V;

an ink that is contained within the ink reservoir, the ink having a density of $D_i$ grams per cubic centimeter and having a volume $V_i$; and a plurality of pellets contained within the ink reservoir, the pellets having a density of $D_p$ grams per cubic centimeter and having a total pellet volume $V_p$, wherein $D_p<D_i$ and wherein $V_p>(V-V_i-2)$ cubic centimeters.

19. The inkjet printing system claimed in claim 17, wherein the ink tank is detachably mounted to the printhead at an ink tank port.

20. The inkjet printing system claimed in claim 18, wherein the ink tank port includes a valve.

* * * * *